United States Patent [19]

Borcher, Sr. et al.

[11] Patent Number: 4,925,577

[45] Date of Patent: May 15, 1990

[54] SOIL RELEASE POLYMER COMPOSITIONS HAVING IMPROVED PROCESSABILITY

[75] Inventors: Thomas A. Borcher, Sr.; Rodolfo Delgado; Toan Trinh, all of Cincinnati, Ohio

[73] Assignee: The Procter & Gamble Company, Cincinnati, Ohio

[21] Appl. No.: 353,261

[22] Filed: May 17, 1989

Related U.S. Application Data

[62] Division of Ser. No. 194,684, May 16, 1988, Pat. No. 4,863,619.

[51] Int. Cl.[5] ..... B05D 1/28; B05D 3/12; D06M 15/507; D06M 21/02

[52] U.S. Cl. ..... 252/8.9; 252/8.8; 252/8.6; 427/242; 427/393.4; 524/376; 524/377

[58] Field of Search ..... 252/8.9, 8.8, 8.6; 427/242, 393.4; 524/376, 377

[56] References Cited

U.S. PATENT DOCUMENTS 4,240,918 12/1980 Lagasse et al. ..... 524/377
4,849,257 7/1989 Borcher, Sr. et al. ..... 252/8.6

*Primary Examiner*—Dennis Albrecht
*Assistant Examiner*—James M. Silbermann
*Attorney, Agent, or Firm*—Robert B. Aylor; Richard C. Witte

[57] ABSTRACT

Polymeric soil release agents that have high viscosities when molten are difficult to process. Certain organic materials can be added to such agents to lower the viscosity and improve processing. Examples of such organic materials include fatty acids, some nonionic ethylene glycol derivatives, polyethylene or polypropylene glycols and their short alkyl chain ethers, certain polyhydroxy and alkyl ether solvents, and aryl ethers of propylene glycol.

8 Claims, No Drawings

SOIL RELEASE POLYMER COMPOSITIONS HAVING IMPROVED PROCESSABILITY

This is a division of application Ser. No. 194,684, filed May 16, 1988, now U S. Pat. No. 4,863,619.

TECHNICAL FIELD

The present invention relates to an improvement in the manufacture of fabric treatment products comprising soil release polymers which have relatively high viscosities, said products being, preferably, either in particulate form or attached to a substrate. Liquid forms can also be prepared more easily. Preferably said polymers are used in combination, e.g., with other conventional fabric conditioning materials in an automatic clothes dryer.

BACKGROUND OF THE INVENTION

The use of soil release polymers in dryer-added fabric conditioning articles is disclosed in the copending, allowed U.S. patent application of Mark D. Evans, Gregory B. Huntington, Robert L. Stewart, Peter H. Wolf, and Roger E. Zimmerer for "ARTICLES AND METHODS FOR TREATING FABRICS," Ser. No. 022,615, filed Mar. 3, 1987, now U.S. Pat. No. 4,749,596, issued June 7, 1988, said patent being incorporated herein by reference.

It has since been discovered that especially preferred soil release polymers are those that have relatively high viscosities when they are in the molten state. Such polymers are difficult to process using conventional equipment.

SUMMARY OF THE INVENTION

It has now been discovered that certain organic materials (viscosity reducing agents) selected from the group consisting of:

(1) fatty acids containing from about 8 to about 22, preferably from about 10 to about 22, more preferably from about 12 to about 18, carbon atoms;

(2) nonionic compounds having a hydrophobic group, preferably derived from phenols or alkyl phenols (including dialkyl phenols), aralkyl alcohols, fatty alcohols, fatty acids, fatty esters (including glycerol, sorbitan, and sucrose esters of fatty acids), fatty amines, quaternary fatty ammonium salts, or mixtures thereof, wherein the fatty alkyl groups, including those in fatty acyl groups, contain from about 4 to about 22 carbon atoms, and at least one ethoxylate hydrophilic group containing from about 1 to about 100, preferably from about 1.5 to about 50, more preferably from about 1.5 to about 20, ethylene oxide groups and mixtures thereof.

(3) polyalkylene glycols, and alkyl ethers thereof, having molecular weights of less than about 3,400, and viscosities at 85° C. of less than about 100 centistokes, including polyethylene glycols having a molecular weight of less than about 3,400; polypropylene glycol having a molecular weight of less than about 1000, mixed poly(ethylene/propylene) glycols having maximum molecular weights of between about 1,000 and about 3,400 depending upon the ratio of ethylene to propylene glycol, and polyethylene glycol methyl ethers having a molecular weight of less than about 2,500, and mixtures thereof;

(4) solvents selected from the group consisting of:

(a) polyhydroxy solvents containing from 2 to about 4 hydroxyl groups and from about 2 to about 6 carbon atoms, such as ethylene glycol; 1,2-propanediol; 1,3-propanediol; glycerol; and mixtures thereof;

(b) alkyl ethers of propylene glycol containing from one to two alkyl groups wherein each alkyl group contains from about 4 to about 6 carbon atoms;

(c) dialkyl ethers of ethylene glycol wherein each alkyl group contains from about 4 to about 6 carbon atoms; and (d) mixtures thereof;

(5) aryl and/or aralkyl ethers of propylene glycol wherein each of said aryl and aralkyl groups contains from 6 to about 8 carbon atoms; and (6) mixtures thereof;

can lower the viscosity of high viscosity soil release polymers, when admixed with said polymers at an effective level, but more than a ratio of about 1:1 polymer to viscosity reducing agent, and thereby improve the processing of such polymers, especially when they are applied to a substrate, either by themselves or in combination with other fabric treatment materials such as cationic fabric softeners.

DESCRIPTION OF THE INVENTION

The present invention comprises a mixture of (A) a soil release polymer, preferably an anionic soil release polymer, melting between about 30° C. and about 90° C. and having a viscosity at 85° C. of greater than about 10,000 cps, and (B) an effective amount, but more than about a 1:1 ratio of (A) to (B), of a viscosity reducing agent selected from the group consisting of:

(1) fatty acids containing from about 8 to about 22, preferably from about 10 to about 22, more preferably from about 12 to about 18, carbon atoms;

(2) nonionic compounds having a hydrophobic group, preferably derived from phenols or alkyl phenols (including dialkyl phenols), aralkyl alcohols, fatty alcohols, fatty acids, fatty esters (including glycerol, sorbitan, and sucrose esters of fatty acids), fatty amines, quaternary fatty ammonium salts, or mixtures thereof wherein the fatty alkyl groups contain from about 4 to about 22, preferably from about 8 to about 18, carbon atoms, and at least one ethoxylate hydrophilic group containing from about 1 to about 100, preferably from about 1.5 to about 50, more preferably from about 1.5 to about 20, ethylene oxide groups and mixtures thereof;

(3) polyalkylene glycols, and alkyl ethers thereof, having molecular weights of less than about 3,400, and viscosities at 85° C. of less than about 100 centistokes, including polyethylene glycols having a molecular weight of less than about 3,400; polypropylene glycol having a molecular weight of less than about 1,000, mixed poly(ethylene/propylene glycol) having maximum molecular weights of between about 1,000 and about 3,400 depending upon the ratio of ethylene to propylene glycol, and polyethylene glycol methyl ethers having a molecular weight of less than about 2,500, and mixtures thereof;

(4) solvents selected from the group consisting of:

(a) polyhydroxy solvents containing from 2 to about 4 hydroxyl groups and from 2 to about 6 carbon atoms, such as ethylene glycol; 1,2-propanediol; 1,3propanediol; glycerol; and mixtures thereof;

(b) alkyl ethers of propylene glycol containing from one to two alkyl groups wherein each alkyl group contains from about 4 to about 6 carbon atoms;

(c) dialkyl ethers of ethylene glycol wherein each alkyl group contains from about 4 to about 6 carbon atoms; and (d) mixtures thereof;

(5) aryl and/or aralkyl ethers of propylene glycol wherein each of said aryl and aralkyl groups contains from 6 to about 8 carbon atoms; and (6) mixtures thereof;

said mixture of (A) and (B) forming a phase stable mixture at about 85° C. with a viscosity of less than about 10,000 cps.

These mixtures permit these desirable soil release polymers to be handled easily including the facile formation of particles and/or coated substrates with these desirable soil release polymers and the incorporation of these polymers in liquid formulations. These mixtures can also be used to formulate detergent compositions.

The level of soil release polymer in the mixture can vary from about 50% to about 95%, preferably from about 60% to about 90%, more preferably from about 70% to about 90%. The viscosity reducing agent can be present in the mixture at a level of from about 5% to about 50%, preferably from about 10% to about 40%, and more preferably from about 10% to about 30%.

In a preferred embodiment, the present invention encompasses an article of manufacture adapted for use to provide fabric soil release benefits and to soften fabrics in an automatic laundry dryer comprising:

I. a fabric conditioning composition having a melting point above about 35° C. and being flowable at dryer operating temperatures, said composition comprising:

i. about 1% to about 70% of a mixture comprising:

(A) from about 1% to about 70% based on the weight of said composition of a polymeric soil release agent having a viscosity at 85° C. of more than about 10,000 cps; and (B) from about 1% to about 35% of viscosity reducing agent selected from the group consisting of:

(1) fatty acids containing from about 8 to about 22, preferably from about 10 to about 22, more preferably from about 12 to about 18, carbon atoms;

(2) nonionic compounds having a hydrophobic group, preferably derived from phenols, alkyl phenols (including dialkyl phenols), aralkyl alcohols, fatty alcohols, fatty acids, fatty esters (including glycerol, sucrose, and sorbitan esters of fatty acids), fatty amines, quaternary fatty ammonium salts, or mixtures thereof wherein the fatty alkyl groups contain from about 4 to about 22 carbon atoms, and at least one ethoxylate hydrophilic group containing from about 1 to about 100, preferably from about 1.5 to about 50, more preferably from about 1.5 to about 20, ethylene oxide groups and mixtures thereof;

(3) polyalkylene glycols, and alkyl ethers thereof, having molecular weights of less than about 3,400, and viscosities at 85° C. of less than about 100 centistokes, including polyethylene glycols having a molecular weight of less than about 3,400; polypropylene glycol having a molecular weight of less than about 1000, mixed poly(ethylene/propylene) glycols having maximum molecular weights between about 1,000 and about 3,400 depending upon the ratio of ethylene to propylene glycol, and polyethylene glycol methyl ethers having a molecular weight of less than about 2,500, and mixtures thereof;

(4) solvents selected from the group consisting of:

(a) polyhydroxy solvents containing from 2 to about 4 hydroxyl groups and from 2 to about 6 carbon atoms, such as ethylene glycol; 1,2-propanediol; 1,3-propanediol; glycerol; and mixtures thereof;

(b) alkyl ethers of propylene glycol containing from one to two alkyl groups wherein each alkyl group contains from about 4 to about 6 carbon atoms;

(c) dialkyl ethers of ethylene glycol wherein each alkyl group contains from about 4 to about 6 carbon atoms; and (d) mixtures thereof;

(5) aryl and/or aralkyl ethers of propylene glycol wherein each of said aryl and aralkyl groups contains from 6 to about 8 carbon atoms; and (6) mixtures thereof;

to lower said viscosity of said polymeric soil release agent (A) to less than about 10,000 cps at about 85° C.; and ii. from about 30% to about 99% of a fabric softening agent; and II. a dispensing means which provides for release of an effective amount of said composition to fabrics in the dryer at automatic dryer operating temperatures, i.e., 35° C. to 115° C.

When the dispensing means is a flexible substrate in sheet configuration the fabric conditioning composition is releasably affixed on the substrate to provide a weight ratio of conditioning composition to dry substrate ranging from about 10:1 to about 0.5:1. The invention also comprises the method of manufacturing such an article of manufacture utilizing said mixture i., either by application of the mixture i. directly to said dispensing means II., or by premixing the mixture i. with the fabric softening agent ii.

The invention also encompasses a method for imparting soil releasing benefits plus a softening and antistatic effect to fabrics in an automatic clothes dryer comprising tumbling said fabrics under heat in a clothes dryer with an effective, i.e., softening, amount of a composition comprising softening active(s) and a soil release agent.

The term "fabric conditioning composition" as used herein is defined as a mixture of a polymeric soil release agent and a fabric softening and/or antistatic agent as defined herein.

The Viscosity Reducing Agent

The viscosity reducing agents that are useful herein include fatty acids, nonionic surfactants, polyethylene glycols, alkylene glycol aryl and aralkyl ethers, and certain organic solvents. In general, the level of such agents should be kept as low as possible since it does not provide any appreciable benefit except in the manufacture of particles and substrates carrying the polymeric soil release agents. The ratio of viscosity reducing agent to polymeric soil release agent is less than about 1:1, preferably less than about 40:60; more preferably from about 30:70 to 10:90 and sufficient to reduce the viscosity of the soil release agent at 85° C. to less than about 10,000 cps.

"Phase stable" as used herein means that the mixture is stable for a sufficient period of time to permit the desired processing to occur. Typically, this is at least about one day, but preferably is at least about one week.

A preferred viscosity reducing agent is fatty acid having from about 8 to about 22, preferably from about 10 to about 22 carbon atoms, more preferably from about 12 to about 18 carbon atoms. Examples of such fatty acids are decanoic, lauric, myristic, palmitic, oleic, stearic, and mixtures thereof.

Fatty alcohols, fatty acid esters, fatty amines, fatty quaternary ammonium salts, etc. which are not ethoxylates whether derived from fatty acids or prepared synthetically, are not very effective. However, these compounds can be used in combination with other effective materials such as the fatty acids, nonionic surfactants, etc., as extenders, with the ratio of effective material to extender being more than about 30:70, preferably more than about 40:60, more preferably more than about 1:1.

Polyethylene glycols having a molecular weight below about 3,400, preferably below about 2,000, more preferably about 1,000, or less, are effective. Higher molecular weight polyethylene glycols are not as effective and require excessive amounts to achieve the same result.

Nonionic surfactants and other molecules which have ethylene oxide moieties and hydrophobic portions are also effective. If such molecules have only one or two ethylene oxide moieties, it is desirable that the hydrophobic portion contain an aromatic moiety, e.g., a benzene ring, especially if the polymeric soil release agent contains aromatic moieties. Suitable examples of these materials include: ethoxylated alkyl phenols such as some Igepal nonionic surfactants sold by GAF Corp. These materials contain an octyl group (Igepal CA), nonyl group (Igepal CO), dodecyl group (Igepal RC) or dialkyl group (Igepal DM). Specific examples include Igepal CO-210 and Igepal CO-430, being nonyl phenol polyethoxylates containing 1.5 and 4 ethylene oxide groups, respectively, and Igepal CA-210, being an octyl phenol polyethoxylate containing 1.5 ethylene oxide groups. Other examples include Triton X-35 and Triton X-45, being octyl phenol polyethoxylates containing 3 and 5 ethylene oxide groups, respectively, and Triton N-57, being nonyl phenol polyethoxylate containing 5 ethylene oxide groups; Triton materials are sold by Rohm and Haas Co.

Other suitable nonionic materials include: polyoxyethylene fatty alkyl ethers, such as Brij 30 and 76, being polyoxyethylene (4) lauryl ether and polyoxyethylene (10) stearyl ether, respectively, sold by ICI Americas.

Suitable polyoxyethylene fatty acid esters include Myrj 45 [polyoxyethylene (8) stearate] sold by ICI Americas, Mapeg 200 ML [polyoxyethylene (MW 200) monolaurate] sold by Mazer Chemicals, Inc., and Ethox MS-23 [polyoxyethylene (23) stearate] sold by Ethox Chemicals, Inc.

Suitable ethoxylated fatty esters include Aldosperse MS-20FG [polyoxyethylene (20) glycerol monostearate] sold by Glyco Chemicals, Inc., and Alkamuls PSMS-4 and -20 [polyoxyethylene (4) sorbitan monostearate and polyoxyethylene (20) sorbitan monostearate], respectively, sold by Alkaril Chemicals.

Suitable ethoxylated fatty amines include Varstat K22 sold by Sherex Chemical Co.

Suitable ethoxylated quaternary fatty ammonium salts include Varstat 66 [ethyl bis(polyethoxy ethanol)alkyl ammonium ethyl sulfate] sold by Sherex Chemical Co.

Other suitable nonionic viscosity reducing agents include: triethylene glycol monobutyl ether sold as Poly-Solv TB by Olin Chemicals or ButDxytriglycol by Union Carbide; polyalkylene glycol monoaryl ethers, such as ethylene glycol monophenyl ether, sold by Union Carbide under the trade name Phenyl Cellosolve, and by GAF Corp. as Igepal OD-410; and polyalkylene glycol monoarylalkyl ethers, such as ethylene glycol monobenzyl ether, sold by Union Carbide under the trade name Benzyl Cellosolve.

The solvents include alkylene glycols, such as ethylene and propylene glycols, glycerine, and mixtures thereof.

The viscosities of the soil release polymers and soil release polymer mixtures with the viscosity reducing agents are determined by a Wells-Brookfield Model RVT Cone/Plate Viscometer, adapted with a Brookfield Temperature Bath Model EX-100 for variable temperature setting. Most of the soil release polymers and mixtures are non-newtonian fluids in the molten state. The viscosities are determined at different shear rates, and intrapolated to the viscosity value at 3.84 $sec^{-1}$ shear rate.

Polymeric Soil Release Agent

The polymeric soil release agents useful in the present invention include (preferably) block copolymers of polyalkylene terephthalate and polyoxyethylene terephthalate, and block copolymers of polyalkylene terephthalate and polyethylene glycol. Preferably, these polymeric soil release agents contain one, or more, negatively charged functional groups such as the sulfonate functional group, preferably as capping groups at the terminal ends of said polymeric soil release agent. The soil release agent is present at a level of from about 1% to about 70%, more preferably from about 10% to about 60%, and most preferably from about 15% to about 50%, by weight of the fabric conditioning composition.

The polymeric soil release agents including nonionic, etc., agents should become molten at temperatures no higher than about 90° C. and have viscosities above about 10,000 cps at 85° C. Other polymeric soil release agents with higher melting points can be used when they dissolve in the viscosity reducing agent, especially those viscosity reducing agents which can act as solvents for the polymeric soil release agent.

Anionic Polymeric Soil Release Agent

The preferred polymeric soil release agents useful in the present invention include anionic polymeric soil release agents (ASRP's). It is surprising that the anionic polymeric soil release agents are compatible with the cationic softener agents of this invention. However, they are compatible and effective.

The anionic soil release agent is present at a level of from about 1% to about 70%, more preferably from about 10% to about 60%, and most preferably from about 15% to about 50%, by weight of fabric conditioning composition.

Anionic polymeric (or oligomeric) soil release agents useful in the present invention have at least one basically hydrophobic moiety; at least one hydrophilic moiety comprising one or more anionic groups; and one or more polyoxyethylene groups.

The hydrophobic moieties comprise oligomeric, or cooligomeric, or polymeric, or copolymeric esters, amides or ethers which taken as a moiety are hydrophobic. The preferred hydrophobic moieties are oligomeric or polymeric esters which comprise alternating terephthaloyl (T) groups, and (AO) groups which are oxyalkyleneoxy, preferably oxy-1,2-alkyleneoxy groups, each alkylene group containing from 2 to about 6 carbon atoms. Other uncharged dicarbonyl groups, especially other aryldicarbonyl groups can be present, at least in a small percentage. Oxyethyleneoxy, oxy-1,2-propyleneoxy, and mixtures thereof are the most preferred (AO) groups for the hydrophobic moieties.

The hydrophilic anionic moieties contain one or more covalently bonded anionic groups such as sulfonate, sulfate, carboxylate, phosphonate, or phosphate groups where said anionic groups are paired with compatible cations. The hydrophilic moieties can optionally comprise nonionic hydrophilic groups in addition to the anionic groups. The preferred hydrophilic anionic moieties contain one or more sulfonate groups. The anionic moieties can either be at the ends of the polymer molecules, e.g., chains, (capping 9roups) or positioned internally along the polymer molecules, e.g., chains. Preferred anionic capping moieties are sulfoaroyl groups, especially sulfobenzoyl groups, and sulfopolyoxyethylene groups, $MO_3S(CH_2CH_2O)_n$—, where M is preferably a compatible cation, and each n is from 1 to about 30, preferably from 1 to about 15, most preferably from 1 to about 3. Internal hydrophilic anionic moieties along the chain are preferably 5-sulfoisophthaloyl groups.

A generic empirical formula for some preferred ASRP's is $(CAP)_x(AO)_y(T)_z(I)_q(En)_r$ wherein: $(AO)_y$ and $(T)_z$ are combined, at least in part, to form one or more hydrophobic moieties; at least one of $(CAP)_x$ and $(I)_q$ comprises the hydrophilic anionic moiety or moieties; and $(E_n)_r$ represents the poly(oxyethylene) group or groups.

In the above generic empirical formula, the following definitions apply:

(I) Each (CAP) represents an end-capping moiety selected from (a) sulfoaroyl groups; (b) groups having the formula $MO_3S$—$(O)_u(RO)_v$ wherein each M is a compatible cation; u is 0 or 1, preferably 0; R is either an ethylene group or mixtures of ethylene and 1,2-propylene groups, and v is from 1 to about 100, preferably from 1 to about 30, more preferably from 1 to about 15; (c) poly(oxyethylene) monoalkyl ether groups, $XO$—$(CH_2CH_2O)_w$—, wherein X is an alkyl group containing from 1 to about 6 carbon atoms, preferably 1 carbon atom and w is from 1 to about 100, preferably from about 6 to about 25; and (d) mixtures thereof. The end-capping moieties are preferably (a), (b), or mixtures thereof, most preferably (a) and x is from 0 to 2, preferably 1 or 2, most preferably about 2.

(II) Each (AO) represents an oxyalkyleneoxy group, excluding oxyalkyleneoxy groups of (I) and (V), containing from 2 to about 6 carbon atoms, preferably 1,2-oxyalkyleneoxy, and most preferably oxyethyleneoxy, oxy-1,2-propyleneoxy, or mixtures thereof, and y is from about 1 to about 80,preferably from about 1 to about 10, most preferably from about 1.25 to about 8.

(III) Each (T) represents a terephthaloyl group. Other noncharged dicarbonyl groups can be present, at least in a small percentage, and especially other noncharged aryl dicarbonyl groups, and z is from about 1 to about 50, preferably, from about 1 to about 10, most preferably from about 1.25 to about 8.

(IV) Each (I) represents an internal anionic group, preferably selected from the group consisting of sulfoaryldicarbonyl groups, sulfoalkylenedicarbonyl groups, and mixtures thereof. The more preferred (1) is selected from the group consisting of sulfobenzene-1,2-dicarbonyl groups; sulfobenzene-1,3-dicarbonyl groups; sulfobenzene-1,4-dicarbonyl groups; and mixtures thereof. The most preferred (I) is a 5-sulfoisophthaloyl group, and q is from 0 to about 30, preferably from 0 to about 5.

(V) Each $(E_n)$ represents a poly(oxyethylene)oxy group —$(OCH_2CH_2)_nO$— wherein each n is from 2 to about 200, preferably from about 6 to about 100, most preferably from about 10 to about 80, and r is from about 0.5 to about 25, preferably from about 0.5 to about 5, most preferably from about 1 to about 2.

(VI) (CAP) and (I) are selected such that said ARSP's contain at least one anionic group.

The ASRP's can have molecular weights of from about 500 to about 40,000, preferably from about 1,000 to about 10,000, so long as the viscosity at 85° C. is more than about 10,000 cps. ASRP's have a balance at hydrophobicity and hydrophilicity that permits them to effectively deposit on fabric surfaces.

Compatible cations include alkali metal (especially sodium and/or potassium), and substituted ammonium (e.g., mono-, di-, or triethanolammonium or tetramethylammonium) cations. Sodium is highly preferred.

Polymers without substantial poly(oxyethylene) content are higher melting (M.P. above about 110° C.) and therefore are even more difficult to formulate.

Desirable lower melting (M.P. of less than about 90° C.) polymers have poly(oxyethylene) groups containing from about 20 to about 100 oxyethylene units. These high viscosity ASRP's can be blended with the fabric conditioning agents by melting and blending with the viscosity reducing agents. "Melting points" (M.P.) are determined by either any conventional melting point determination apparatus, or by observing the phase transition in a differential scanning calorimetry apparatus.

Specific ASRP's of interest include those of the U.S. patent application of Rene Maldonado, Toan Trinh and Eugene Paul Gosselink for SULFOAROYL END-CAPPED ESTER OLIGOMERS SUITABLE AS SOIL-RELEASE AGENTS IN DETERGENT COMPOSITIONS AND FABRICCONDITIONER ARTICLES, Ser. No. 105,421, filed Sept. 4, 1987, now U.S. Pat. No. 4,877,896, issued Oct. 31, 1989, said patent being incorporated herein by reference.

Such ASRP's include oligomeric or low molecular weight polymeric, substantially linear, sulfoaroyl end-capped esters, said esters comprising unsymmetrically substituted oxy-1,2-alkyleneoxy units, and terephthaloyl units, in a mole ratio of oxy-1,2-alkyleneoxy to terephthaloyl ranging from about 2:1 to about 1:24. (Mixtures of such esters with reaction by-products and the like retain their utility as fabric soil release agents when they contain at least 10% by weight of said linear, end-capped esters.) The preferred esters herein are of relatively low molecular weight (i.e., outside the range of fiber-forming polyesters) typically ranging from about 1,000 to about 20,000.

The essential end-capping units of these preferred ASRP's of said U.S. Ser. No. 105,421, supra, are anionic hydrophiles, connected to the esters by means of aroyl groups. Preferably, the anion source is a sulfonated group, i.e., the preferred end-capping units are sulfoaroyl units, especially those of the formula $(MO_3S)(C_6H_4)C(O)$—, wherein M is a compatible (especially salt-forming) cation such as Na or tetraalkylammonium.

The preferred "unsymmetrically substituted oxy-1,2-alkyleneoxy" units of the esters herein are units selected from the group consisting of (a) —OCH($R^a$)CH($R^b$)O— units, wherein $R^a$ and $R^b$ are selected so that in each of said units, one of said groups is H and the other is a nonhydrogen R group, and (b) mixtures of the foregoing units wherein the nonhydrogen R groups are different. Mixtures of the unsymmetrical units (a) or (b) with —$OCH_2CH_2O$— units are also acceptable, provided that the units taken together have, overall, a sufficiently unsymmetrical character. A convenient measure of the unsymmetrical character required is given by the mole ratio of units (a) or (b) to —$OCH_2CH_2O$— units, which must lie in the range from about 1:10 to about 1:0. In the above, R is always a nonhydrogen, noncharged group, has low molecular weight (typically below about 500), is chemically unreactive (especially in that it is a nonesterifiable group), and is comprised of C and H, or of C,H and 0. In the above-defined mixtures of units (a) or (b) with —$OCH_2CH_2O$— units, specifically excluded are poly(oxyethylene)oxy units, i.e., $-(OCH_2CH_2)_nO$— wherein n is a number greater than or equal to 2. [Such poly(oxyethylene)oxy units form a separate category of units as further discussed hereinafter.] The preferred R groups are selected from the group consisting of lower n-alkyl groups, such as methyl, ethyl, propyl and butyl. Thus, the preferred oxy-1,2-alkyleneoxy units are oxy-1,2-propyleneoxy; oxy-1,2-butyleneoxy; oxy-1,2pentyleneoxy; and oxy-1,2-hexyleneoxy units. Especially preferred by way of oxy-1,2-alkyleneoxy units are oxy-1,2-propyleneoxy units (a), and mixtures thereof with oxyethyleneoxy units (c) in the above-defined mole ratios.

Certain noncharged, hydrophobic aryldicarbonyl units are also essential for these preferred ASRP's (U.S. Ser. No. 105,421, supra). Preferably, these are exclusively terephthaloyl units. Other noncharged, hydrophobic aryldicarbonyl units, such as isophthaloyl or the like, can also be present if desired, provided that the soil release properties of the esters (especially polyester substantivity) are not significantly diminished.

It is desirable to incorporate some poly(oxyalkylene)oxy units such as poly(oxyethylene)oxy units into the esters to lower their melting points. It is also possible, optionally, to incorporate additional hydrophilic units into the esters. These can be anionic hydrophilic units capable of forming two ester bonds. Suitable anionic hydrophilic units of this type are illustrated by sulfonated dicarbonyl units, such as sulfosuccinyl, i.e., —(O)CCH($SO_3M$)$CH_2$C(O)—; or more preferably, sulfoisophthaloyl, i.e., —(O)C($C_6H_3$)($SO_3M$)C(O)— wherein M is a compatible (e.g., salt-forming) cation.

Thus, preferred esters herein comprise, per mole of said ester, (i) from about 1 to about 2 moles of sulfoaroyl end-capping units (groups), preferably sulfobenzoyl end-capping units of the formula ($MO_3S$)($C_6H_4$)C(O)— wherein M is a salt-forming cation;

(ii) for about 2 to about 50 moles of oxy-1,2-propyleneoxy units or mixtures thereof with oxyethyleneoxy units or, optionally, all oxyethyleneoxy units;

(iii) from about 1 to about 40 moles of terephthaloyl units; and (iv) for about 0.5 to about 25 moles of poly(oxyethylene)oxy units of the formula —$(OCH_2CH_2)_nO$— wherein the average degree of ethoxylation n ranges from 2 to about 100.

The "backbone" of the esters herein can further optionally comprise, per mole of said ester, (v) from 0 to about 30 moles of sulfobenzenedicarbonyl units, preferably 5-sulfoisophthaloyl units, of the formula —(O)C($C_6H_3$)($SO_3M$)C(O)— wherein M is a saltforming cation.

The end-capping sulfoaroyl units used in these esters are preferably sulfobenzoyl as in i), and most preferably not more than about 0.15 mole fraction of said sulfobenzoyl end-capping unit are in para- form. Most highly preferred are esters wherein said sulfobenzoyl end-capping units are essentially in ortho- or meta- form. Preferred end-capped esters herein are essentially in the doubly end-capped form, comprising about 2 moles of said sulfobenzoyl end-capping units per mole of said ester.

The ester "backbone" of the compositions, by definition, comprises all the units other than the end-capping units; all the units incorporated into the esters being interconnected by means of ester bonds. Thus, in one simple preferred embodiment, the ester "backbones" comprise only terephthaloyl units and oxy-1,2-propyleneoxy units. In other preferred embodiments incorporating oxyethyleneoxy units, the ester "backbone" comprises terephthaloyl units, oxy-1,2-propyleneoxy units, and oxyethyleneoxy units, the mole ratio of the latter two types of unit preferably ranging from about 1:10 to about 1:0 as previously noted. If hydrophilic units in addition to the end-capping units, e.g., poly(oxyethylene)oxy units, 5-sulfoisophthaloyl units, or mixtures thereof, are present in the backbone, they generally will comprise at least about 0.02 moles per mole of said ester.

Preferred compositions provided by the invention are illustrated by one comprising from about 25% to about 100% by weight of ester having the empirical formula $(CAP)_x(EG/PG)_y(T)_z(E_n)_r$ wherein (CAP) represents the sodium salt form of said sulfobenzoyl endcapping units i); (EG/PG) represents said oxyethyleneoxy and oxy-1,2-propyleneoxy units ii); (T) represents said terephthaloyl units iii); (En) represents said poly(oxyethylene)oxy units v), which are further characterized in having an average degree of ethoxylation n which ranges from about 2 to about 100; x is from about 1 to 2; y is from about 2.25 to about 39; z is from about 1 to about 34; r is from about 0.05 to about 10; and wherein x, y, z and r represent the average number of moles of the corresponding units per mole of said ester. Preferably in such compositions, the oxyethyleneoxy:oxy-1,2-propyleneoxy mole ratio of said units ii) ranges from about 0:1 to about 7:1; x is about 2, y is from about 2.25 to about 17, z is from about 1.75 to about 18 and r is from about 0.5 to about 2. More preferably, in such esters x is about 2, y is from about 4 to about 8, z is from about 4 to about 8, r is about 1 and n is from about 30 to about 85 (more preferably from about 60 to about 85; most preferably about 77). Most preferably, such ester mixtures are comprised of at least about 50% by weight of said ester having molecular weights ranging from about 2,000 to about 12,000. In a preferred synthesis and composition in accordance with the above-defined numbers of units, water-soluble or dispersible ester mixtures are prepared by a process which comprises reacting dimethyl terephthalate; ethylene glycol; 1,2-propylene glycol; a poly(ethylene glycol) having an average degree of ethoxylation ranging from about 30 to about 85, and a compound selected from the group consisting of monovalent cation salts of sulfobenzoic acid and its $C_1$–$C_4$ alkyl carboxylate esters, in the presence of at least one conventional transesterification catalyst.

Molecular Geometry—These preferred esters are preferably "substantially linear", in the sense that they are not significantly branched or crosslinked by virtue of the incorporation into their structure of units having more than two ester-bond forming sites. (For a typical example of polyester branching or crosslinking, see U.S. Pat. No. 4,554,328, Sinker et al., issued Nov. 19, 1985, and incorporated herein by reference.) Furthermore, no cyclic esters are essential, but can be present in the compositions at low levels as a result of side-reactions during ester synthesis. Preferably, cyclic esters will not exceed about 2% by weight of the compositions; most preferably, they will be entirely absent from the compositions.

Contrasting with the above, the term "substantially linear" as applied to the esters herein does, however, expressly encompass materials which contain side-chains which are unreactive in ester-forming or transesterification reactions. Thus, oxy-1,2-propyleneoxy units are of an unsymmetrically substituted type essential in the preferred embodiment; their methyl groups do not constitute what is conventionally regarded as "branching" in polymer technology (see Odian, Principles of Polymerization, Wiley, N.Y., 1981, pages 18–19, with which the present definitions are fully consistent), are unreactive in ester-forming reactions, and are highly desirable for the purposes of the invention. Optional units in the esters of the invention can likewise have side-chains, provided that they conform with the same nonreactivity criterion.

Molecular Units—These preferred esters comprise repeating backbone units, and end-capping units. To briefly illustrate, in the preferred embodiment, molecules of the ester are comprised of three kinds of essential units, namely (i) sulfobenzoyl end-capping units of the formula $(MO_3S)(C_6H_4)C(O)$— wherein M is a salt-forming cation;

(ii) oxy-1,2-propyleneoxy units, i.e., $—OCH(CH_3)CH_2O—$ or $—OCH_2CH(CH_3)O—$, or mixtures thereof with oxyethyleneoxy units, i.e., $—OCH_2CH_2O—$. Note that the latter units are defined as excluding oxyethyleneoxy units which are connected together to form a poly(oxyethylene)oxy chain comprising two or more consecutive oxyethylene units;

(iii) terephthaloyl units, i.e., $—(O)CC_6H_4C(O)—$; note that as generally used herein, the latter formula is indicative of a

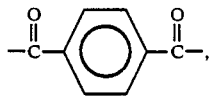

units; and (iv) poly(oxyethylene)oxy units of the formula $—(OCH_2CH_2)_nO—$ wherein the average degree of ethoxylation n ranges from 2 to about 100.

Optionally, the esters herein can also, in addition to units of types (i)–(iv), contain other anionic hydrophilic units, which most preferably are (v) 5-sulfoisophthaloyl units of the formula $—(O)C(C_6H_3)(SO_3M)C(O)—$ wherein M is a salt-forming cation.

Units of the esters will be provided by well-known and readily identifiable reagents; for example, poly(ethylene glycol)s, such as PEG-3400 (degree of ethoxylation=about 77), are a suitable source of poly(oxyethylene)oxy units for use herein; and dimethyl-5-sulfoisophthalate, sodium salt, is an example of a reagent capable of providing 5-sulfoisophthaloyl units for optional incorporation into the esters of the invention. It is generally preferred that all units of the types (iv) and (v) defined hereinabove should be provided by reactants in ester or alcohol forms.

When starting with the simplest reactants as illustrated above, the overall synthesis is usually multi-step, involving at least two stages, such as an initial esterification or transesterification (also known as ester interchange) stage, followed by an oligomerization or polymerization stage, in which molecular weights of the esters are increased, but only to the limited extent specified hereinbefore.

Formation of ester-bonds involves elimination of low molecular weight by-products such as water, or simple alcohols. Complete removal of the latter from reaction mixtures is generally somewhat easier than removal of the former. However, since the esterbond forming reactions are generally reversible, it is necessary to "drive" the reactions forward in both instances, removing these by-products.

In practical terms, in the first stage (ester interchange) the reactants are mixed in appropriate proportions and are heated, to provide a melt, at atmospheric or slightly superatmospheric pressures (preferably of an inert gas such as nitrogen or argon). Water and/or low molecular weight alcohol is liberated and is distilled from the reactor at temperatures up to about 200° C. (A temperature range of from about 150°–200° C. is generally preferred for this stage).

In the second (i.e., oligomerization) stage, vacuum or inert gas sparging techniques and temperatures somewhat higher than in the first stage are applied; removal of volatile by-products and excess reactants continues, until the reaction is complete, for example as monitored by conventional spectroscopic techniques. (Inert gas sparging which can be used in this stage involves forcing an inert gas, such as nitrogen or argon, through the reaction mixture to purge the reaction vessel of the above-mentioned volatiles; in the alternative, continuously applied vacuum, typically from about 10 mm Hg to about 0.1 mm Hg can be used; the latter technique is preferred especially when high viscosity melts are being reacted).

In both of the above-described reaction stages, it is necessary to balance on one hand the desire for rapid and complete reaction (higher temperatures and shorter times preferred), against the need to avoid thermal degradation (which undesirably might result in off-colors and by-products). It is possible to use generally higher reaction temperatures especially when reactor design minimizes super-heating or "hot spots"; also, ester-forming reactions in which ethylene glycol (rather than exclusively 1,2-propylene or higher glycols) is present, are more tolerant of higher temperatures. Thus, a suitable temperature for oligomerization lies most preferably in the range of from about 150° C. to about 260° C. when ethylene glycol is present and in the range of from about 150° C. to about 240° C. when it is absent (assuming that no special precautions, such as of reactor design, are otherwise taken to limit thermolysis).

It is very important in the above-described procedure to use continuous mixing, so that the reactants are always in good contact; highly preferred procedures involve formation of a well-stirred homogeneous melt of the reactants in the temperature ranges given above. It is also highly preferred to maximize the surface area of reaction mixture which is exposed to vacuum or inert gas to facilitate the removal of volatiles, especially in the oligomerization or polymerization step; mixing equipment of a high-shear vortex-forming type and gas spargers giving good gas-liquid contact are best suited for this purpose.

Catalysts and catalyst levels appropriate for esterification, transesterification, oligomerization, and for combinations thereof, are all well-known in polyester chemistry, and will generally be used herein; as noted above, a single catalyst will suffice. Suitably catalytic metals are reported in Chemical Abstracts, CA83:178505v, which states that the catalytic activity of transition metal ions during direct esterification of K and Na carboxybenzenesulfonates by ethylene glycol decreases in the order Sn (best), Ti, Pb, Zn, Mn, Co (worst).

The reactions can be continued over periods of time sufficient to guarantee completion, or various conventional analytical monitoring techniques can be employed to monitor progress of the forward reaction; such monitoring makes it possible to speed up the procedures somewhat, and to stop the reaction as soon as a product having the minimum acceptable composition is formed.

Appropriate monitoring techniques include measurement of relative and intrinsic viscosities, acid values, hydroxyl numbers, $^{1}H$ and $^{13}C$ nuclear magnetic resonance (n.m.r.) spectra, and liquid chromatograms.

Most conveniently, when using a combination of volatile reactants (such as a glycol) and relatively involatile reactants (such as m-sulfobenzoic acid and dimethyl terephthalate), the reaction will be initiated with excess glycol being present. As in the case of ester interchange reactions reported by Odian (op. cit.), "stoichiometric balance is inherently achieved in the last stages of the second step of the process". Excess glycol can be removed from the reaction mixture by distillation; thus, the exact amount used is not critical.

Typically herein, when calculating the relative proportions of reactants to be used, the following routine is followed, as illustrated for a combination of the reactants m-sulfobenzoic acid monosodium salt (A); 1,2-propylene glycol (B); dimethylterephthalate (C); and polyethylene glycol (D):

1. the desired degree of end-capping is selected; for the present example, the value 2, most highly preferred according to the invention, is used;

2. the average calculated number of terephthaloyl units and nonvolatile poly(oxyethylene)oxy units, in the backbone of the desired ester are selected; for the present example, the value 8 for the terephthaloyl units, and 1 for the poly(oxyethylene)oxy unit are used;

3. the mole ratio of (A) to (C) to (D) should thus be 2:8:1; amounts of the reactants (A), (C), and (D) are taken accordingly; and 4. an appropriate excess of glycol is selected; typically 2 to 10 times the number of moles of dimethyl terephthalate is suitable.

A selection of the ratios of the various reactants will be made in accordance with the desired ratios of the resulting moieties, etc.

A specific soil release agent of the type disclosed in U.S. Ser. No. 105,421, supra, and useful in the present invention is:

Soil Release Agent I

An ester composition is made from m-sulfobenzoic acid monosodium salt, poly(ethylene glycol) (MW=3400), 1,2-propylene glycol and dimethyl terephthalate. Soil Release Agent I illustrates an ester composition wherein the doubly-capped ester molecules not only have sulfonated end-capping units by way of hydrophilic units, but also incorporate uncharged, i.e., nonionic, hydrophilic units in the ester backbone. Also illustrated is a catalyst addition sequence differing from that of the previous soil release agents.

Into a 250 ml, three-necked, round bottom flask, fitted with a thermometer, magnetic stirrer and modified Claisen head, the latter connected to a condenser and receiver flask, are placed, under argon, m-sulfobenzoic acid monosodium salt (13.2 g; 0.059 moles; Eastman Kodak) and 1,2-propylene glycol (35.7 g, 0.47 moles, Fisher). The mixture is stirred and heated steadily under argon at atmospheric pressure, to reach a temperature of about 200° C. The reaction conditions are kept constant, while distillate (1.06 g; 100% based on the theoretical yield of water) is collecting in the receiver flask, and the temperature is then allowed to fall to about 170°-175° C. To the clear, colorless reaction mixture are added, under argon, hydrated monobutyltin(IV) oxide (0.2 g; 0.1% w/w), dimethyl terephthalate (45.0 g; 0.23 moles: Aldrich), and $HO(CH_2CH_2O)_nH$ (100.0 g; 0.029 moles; n averages 77; m.w. =3400; Aldrich). Also added, as antioxidant, is BHT (0.2 g; Aldrich). Over 18-19 hours, the mixture is stirred and heated under argon at atmospheric pressure, at temperatures ranging from about 175°-195° C.; this reaction period is followed by a further 4 hour reaction period in which all reaction conditions, with the exception of temperature (now raised to about 200° C.), are unchanged. The methanol which is liberated in the transesterification is continuously collected. The mixture is cooled to about 50° C. and is transferred under argon to a Kugelrohr apparatus (Aldrich). The apparatus is evacuated to a pressure of 0.1 mm Hg. While maintaining the vacuum and stirring, the temperature is raised to 200° C., and the temperature is then held constant for about 10 hours to allow completion of the synthesis. (In an alternative procedure, n.m.r. spectroscopic monitoring confirms that the reaction is substantially complete after only 6-8 hours.) During this period, excess glycols distill from the homogeneous mixture.

In referring to the ester composition of this example, the following conventions will be used:

| | | | |
|---|---|---|---|
| (CAP) | = | end-capping units | (i) |
| (PG) | = | oxy-1,2-propyleneoxy units | (ii) |
| (T) | = | terephthaloyl units | (iii) |
| ($E_n$) | = | poly(oxyethylene)oxy units, average degree of ethoxylation = n | (iv) |

Using the above convention, Soil Release Agent I has the empirical formula representation:

$$(CAP)_2(PG)_8(T)_8(E_{77})_1.$$

A product made according to the above procedure had a transition point range of from about 40° C. to about 50° C. as determined by a differential scanning calorimetry method, and had a viscosity of about 40,000 cps at 85° C. and 3.84 $sec^{-1}$ shear rate. Other suitable ASRP's are those described in U.S. Pat. No. 4,721,580 of Eugene P. Gosselink for ANIONIC END-CAPPED OLIGOMERIC ESTERS AS SOIL RELEASE AGENTS IN DETERGENT COMPOSITIONS, issued Jan. 26, 1988, said patent being incorporated herein by reference.

Such oligomeric soil release esters having at least one anionic substituent group, said esters having the formula $$Q\text{-}[Z\text{—}O\text{—}R\text{—}O]_x Z\text{—}Q' \text{ (di-anionic)} \qquad \text{I}$$

or $$Q''\text{-}[Z\text{—}O\text{—}R\text{—}O]_y H \text{ mono-anionic} \qquad \text{II}$$

or mixtures thereof; wherein Q, Q' and Q'' can be the same or different anionic substituents and are members selected from the group consisting of $MO_3S(CH_2CH_2O)_n$—, $MO_3S\text{-}(L)_q(YO)_m(CH_2CH_2O)$—hd r and mixtures thereof wherein M is H or a salt-forming cation, L is phenoxyethoxy, phenoxypropoxy or $C_1$–$C_6$ alkoxy, Y is —$CH_2CH(CH_3)$— or —$CH(CH_3)CH_2$—, n is an integer from 1 to 30, q is 1 or 0, m is an integer from 0 to 15 provided that m +q is at least 1, and r is an integer from 0 to 30; x and y can be the same or different and are each integers ranging from 0 to 20 and from 1 to 20, respectively; the R- substituents of the formulae I and II can be the same or different alkylene substituents selected from the group consisting of —$CH_2CH_2$—, —$CH_2CH(X)$— and —$CH(X)CH_2$— wherein X is methyl, ethyl, methoxymethyl, or $C_1$–$C_4$-alkylpoly(oxyalkylene)oxymethyl, or mixtures thereof; and the Z-substituents of the formulae can be the same or different aryldicarbonyl substituents selected from the group consisting of

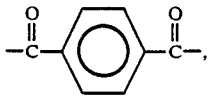

and mixtures thereof with aryl 1,3-dicarbonyl or substituted aryl-1,3-dicarbonyl or substituted aryl-1,4-dicarbonyl groups.

Particularly preferred are those mono- and di-anionic esters wherein Z is

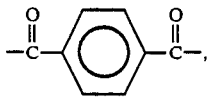

all R substituents are independently selected from —$CH_2CH_2$—, —$CH_2CH(CH_3)$— and —$CH(CH_3)CH_2$—, and Q, Q' and Q'' can be the same or different and are each selected from $NaO_3S(CH_2CH_2O)_n$ wherein n is an integer from 2 to 15, and x and y are integers of from 3 to 7 and from 4 to 8, respectively.

The content of such preferred esters, incorporating from at least four to about eight terephthalate groups in the molecular structure, is at least 2 weight percent in preferred mixtures of the esters, the compositions of which are given in more detail hereinafter.

The preferred anionic oligomeric soil release esters useful in the present invention have specific sulfoethoxylated end-caps, and are of the general formulae:

$$Q\text{-}[Z\text{—}O\text{—}R\text{—}O]_x Z\text{—}Q' \text{ (di-anionic esters)} \qquad \text{I}$$

There should only be minimal amounts of $$Q''\text{-}[Z\text{—}O\text{—}R\text{—}O]_y H \text{ (mono-anionic esters)} \qquad \text{II}$$

In these formulae, Q, Q' and Q'' are all capping groups selected from the group consisting of $MO_3S(CH_2CH_2O)_n$— wherein n is an integer from 1 to 30 or, more preferably, from 1 to about 15, and M is H or a salt-forming cation such as an alkali metal, ammonium, substituted ammonium, or the like.

The composition of the anionic oligomeric esters with respect to groups Q, Q' and Q'' can be modified in four distinct ways:

(a) by selection of $MO_3S(CH_2CH_2O)_n$-containing reagent(s) used in the synthesis;
(b) by physical separation after synthesis;
(c) by mixing or blending after synthesis;
(d) by selecting anionic caps other than $MO_3S(CH_2CH_2O)_n$— *or, undesirably, a proportion of a nonsulfonated poly(oxyethylene) monoalkyl ether capping reagent.*

In the above, modification (a) is preferred; (b) and (c) are less convenient, and (d) is only tolerable provided that the soil release properties, paint compatibility, and formulability of the oligomeric esters are not adversely affected.

In general, practice of (a) above to arrive at particular combinations of Q, Q' and Q'' groups can involve any of three effective variations:

(i) when each molecule of the $MO_3S(CH_2CH_2O)_n$— containing reagent used in synthesis has the same, fixed integral value of n, e.g., 3, 6, 9, or 13, then the Q, Q' and Q'' groups of the anionic oligomeric esters will be identical, since all will have the same fixed value of n as in the reagent;

(ii) when the source of $MO_3S(CH_2CH_2O)_n$— groups is a nonfractionated or commercial ethoxylate having a statistical distribution of n values, a statistical distribution of values of n will characterize the resulting anionic oligomeric esters. Any individual oligomeric ester molecule will have any of the different, statistically allowed values of n for the different $MO_3S(CH_2CH_2O)_n$— groups. The anionic oligomeric ester mixtures resulting from the use of such commercial ethoxylates in the syntheses herein will be further characterized in having a mean or average value of n (denoted $\bar{n}$) such that $1<\bar{n}<15$. The ethoxylate distributions are expected to be skewed, monomodal distributions resembling those typically obtained in commercial ethoxylation reactions. (See N. Schonfeldt, "Surface Active Ethylene Oxide Adducts," Pergamon, New York, 1969, pp. 47–62, for further details on this subject.) It is to be understood that all such compounds having the end-cap ethoxylation variations noted are useful in the practice of this invention. For cost reasons it is generally preferred to use nonfractionated commercial reagents in their synthesis;

(iii) when the source of $MO_3S(CH_2CH_2O)_n$— groups is a mixture of one or more $MO_3S(CH_2CH_2O)n$— containing reagents having different values of n, then the Q, Q' and Q'' groups of the resulting anionic oligomeric ester mixture will have any of the values of n allowed by the reagent mixture, the proportions being governed by the composition of the reagent mixture.

The anionic capping groups of the oligomeric esters contain a substituent M which in any individual oligomeric ester molecule may be H or a salt-forming cation. It should be recognized that, through their tendency to promote hydrolysis, high concentrations of acidic esters or acidic capping reagents can undesirably affect the stability of the oligomeric esters of the invention. For this reason, the oligomeric esters of most practical importance in the present invention will generally have primarily M=Na, or similar cation, rather than M=H substitution. Most generally as prepared, however, M in each anionic oligomeric ester molecule will selected from, e.g., H, Na, tetraalkylammonium, and mixtures thereof. The identity and proportions of M substituents arising from any synthesis will depend exclusively upon the proportion of different M substituents present in the $MO_3S(CH_2CH_2O)_n$— containing reagents used in the synthesis of the esters. However, ion exchange can be conducted on the esters to prepare esters having a variety of other M substituents, some of which would not be feasible to prepare directly, such as the ethanolammonium salts. It is, of course, understood and appreciated that in defining the esters useful in the present invention it is intended to include both the commercially accessible ethoxylate mixtures and the commercially accessible acid or salt forms of the esters, or mixtures thereof, as well as the salt forms which can result by formulating the oligomeric esters into commercial products containing salt-forming cations.

Alternative, effective anionic soil release esters useful in the present invention have anionic capping groups Q, Q′ and Q″ which are the same or different and are selected from groups $MO_3S\text{-}(L)_q(YO)_m(CH_2CH_2O)$ wherein M is H or a salt-forming cation, L is phenoxyethoxy, phenoxypropoxy or $C_1$–$C_6$ alkoxy, Y is —$CH_2CH(CH_3)$— or —$CH(CH_3)CH_2$—, q is 1 or 0, m is an integer from 0 to 15 provided that m +q is at least 1, and r is an integer from 0 to 30. Mixtures of these alternatively capped esters with the hereinbefore defined $MO_3S(CH_2CH_2O)_{\overline{n}}$ capped esters are likewise effective soil release agents.

The oligomeric backbones of the anionic esters of the invention comprise $\text{-}\!\!\{\text{Z—O—R—O}\}\!\!\text{-}$ moieties, wherein the Z— substituents can be the same or different aryldicarbonyl substituents which are independently selected from the group consisting of

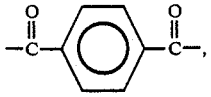

and mixtures thereof with aryl-1,3-dicarbonyl, substituted aryl-1,3-dicarbonyl or substituted aryl-1,4-dicarbonyl groups, and the R-substituents can be the same or different alkylene substituents selected from the group oonsisting of —$CH_2CH_2$—, $CH_2CH(X)$— and —$CH(X)CH_2$— wherein X is methyl, ethyl, methoxymethyl or $C_1$–$C_4$-alkylpoly(oxyalkylene)oxymethyl, or mixtures thereof. Preferred oligomeric backbones contain

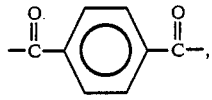

as Z-substituents and exclusively ethylene, 1,2-propylene or mixtures thereof as R-substituents. Esters having at least 0 1 mole fraction of —$CH_2CH(CH_3)$— and —$CH(CH_3)CH_2$— substituents, when the total number of moles of R substituents is taken to be 1.0, are highly preferred; the unsymmetrically placed methyl group in these 1,2-propylene substituents can (without intending to be limited by theory) have desirable effects on formulability and thereby also on soil-release effectiveness. The $\text{-}\!\!\{\text{Z—O—R—O}\}\!\!\text{-}$ moieties can be randomly connected as in the illustrative partial formula A:

$$\text{-}\!\!\{\text{Z}'\text{—O—R}^a\text{-O}\}\!\!\{\text{Z}^2\text{—O—R}^b\text{—O}\}\!\!\{\text{Z}^3\text{—O—R}^c\text{—O}\}\!\!\{\text{Z}^2\text{—O—R}^b\text{—O}\}\!\!\text{-} \qquad \text{A:}$$

wherein Z′, $Z^2$ and $Z^3$ are all

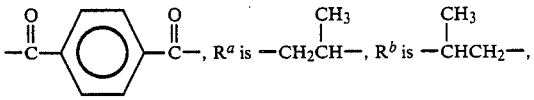

and $R^c$ is —$CH_2CH_2$—. Alternatively, the —Z—O—R—O— moieties can be connected in, "blocks" such as in the illustrative formula B:

$$\text{-}\!\!\{\text{Z}'\text{—O—R}^a\text{—O}\}\!\!\{\text{Z}'\text{—O—R}^c\text{—O}\}\!\!\text{-}_j \qquad \text{B:}$$

wherein Z′ is

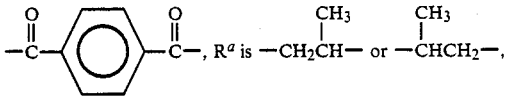

and $R^c$ is —$CH_2CH_2$—.

Formula B indicates empirically a degree of polymerization i with respect to inclusion of 1,2-propylene-derived moieties and a degree of polymerization j with respect to inclusion of ethylenederived $\text{-}\!\!\{\text{Z—O—R—O}\}\!\!\text{-}$ moieties. The numbers represented by i and j, used illustratively here, are directly determined by the mole fractions of the alkylene substituents. Formula B, illustrating the oligomeric backbones of certain anionic esters useful in the invention, is not necessarily restricted to backbones having only two distinct blocks; the representation includes both such a symmetrical derivative and derivatives with progressively higher randomness of structure, ultimately also including essentially random oligomers.

Most generally, no attempt is made to arrive at a particular degree of order in the oligomeric backbone. However, by adjusting parameters such as the time, temperature and proportions of particular oligomeric reactants and sequence of addition in the syntheses described more fully below, the ordering of —Z—O—R—O— units in the backbones of the oligomeric esters could be influenced, with potential advantage for the formulability and use of the oligomeric esters as soil release agents.

The oligomeric backbones of formulae I and II indicate the overall degree of oligomerization of said backbones by integers x and y respectively. Integers x and y may be the same or different, x being selected from 0 to about 20 and y being selected from 1 to about 20. Oligomeric esters with individual integer values of x and y can be fractionated. Mixtures of esters which are inherently the result of the synthetic procedure used are preferred for cost-effectiveness and formulability and will generally be further characterized in having a particular, not necessarily integral, average degree of polymerization. It is believed that under such circumstances this average degree of polymerization will be about the same for both mono- and di-anionic esters copresent in these mixtures which are the direct result of the synthetic procedure (y will not be independent of x). The average degree of polymerization denoted $\bar{x}$ will then be in the range $0.3 \leqq \bar{x} \leqq 7$. At the molecular level, the y values in structure II will then generally coincide with X+1. However, blended compositions can be prepared in which x and y are not necessarily related variables.

Particularly preferred mono- and di-anionic esters of the invention are those wherein Z is

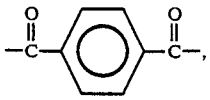

all R substituents are independently selected from $-CH_2CH_2-$, $-CH_2CH(CH_3)-$ and $-CH(CH_3)CH_2-$, Q, Q' and Q'' can be the same or different and are each selected from $NaO_3S(CH_2CH_2O)_n$ wherein n is an integer from 1 to about 15, and x and y are integers of from 3 to 7 and from 4 to 8, respectively. The selection of M=Na in such preferred ester compositions is associated with the lower cost and environmental acceptability of this salt-forming cation.

Highly preferred mixtures of mono- and di-anionic esters of the invention comprise at least 2 weight percent of the preferred $NaO_3S(CH_2CH_2O)_n$ capped esters having four to eight terephthalate substituents, together with esters of otherwise identically defined molecular structures but containing less than four, or more than eight terephthalate units. As hereinbefore indicated, the lower molecular weight component of the latter esters is considered unlikely to be optimally fabric substantive, but can be particularly effective in solubilizing the preferred anionic oligomeric esters. While not intending to be limited by theory, this can indirectly enhance the formulability and soil release effectiveness of the preferred oligomeric esters. Irrespective of theory, the ester mixtures herein are effective for the purposes of practicing the invention, and will generally have average molecular weights below about 4,000, more preferably below about 3,000.

The weight ratio of oligomeric esters having structure I (di-anionic) and structure II (mono-anionic) in preferred mixtures of mono- and di-anionic esters useful in the invention will generally be between about 30:1 and about 1:20 in preferred ester mixtures; control of such ratios is taught in the synthetic methods herein.

The sulfonated oligomeric esters useful in the present invention are typically formed from (1) ethylene glycol, 1,2-propylene glycol or a mixture thereof; (2) a compound or mixture of compounds of the formula $NaO_3S(CH_2CH_2O)_nH$ wherein n is as disclosed above; and (3) a dicarboxylic acid or its diester, dimethyl terephthalate being preferred. The respective amounts of these three component reagents are selected to prepare oligomeric esters having the desired properties in terms of formulability and soil release properties.

Component reagents $NaO_3S(CH_2CH_2O)_nH$ can be prepared by use of the method disclosed in U.S. Pat. No. 4,721,580, supra. incorporated herein by reference; it is anticipated that an alternative method of U.S. Pat. No. 3,823,185, Schlossman, issued July 9, 1974, and incorporated herein by reference, can equally be applicable.

Preferably, the only dicarboxylic acid derivative used is terephthalic acid or its diesters; the dimethyl ester is preferred. However, minor amounts of other aromatic dicarboxylic acids (or their diesters), or aliphatic dicarboxylic acids (or their diesters) can be included to the extent that the soil release properties are substantially maintained. Illustrative examples of other aromatic dicarboxylic acids which can be optionally used include isophthalic acid, phthalic acid, naphthalene-, anthracene- and biphenyldicarboxylic acids, as well as their dialkyl esters and mixtures of these acids. If aliphatic dicarboxylic acids are included, adipic, pimelic, azelaic, sebacic, suberic, 1,4-cyclohexanedicarboxylic and dodecanedioic acids can be used.

The preferred method for preparing the oligomeric esters of the present invention comprises: a) transesterification (also known as ester interchange reaction) of the mixed component reagents in selected proportions and b) polymerization of the resultant low molecular weight oligomers to the desired degree (but invariably avoiding the formation of high polymers), this step being carried out either in the originally used reaction vessel, or in a separate apparatus such as a Kugelrohr. The general reaction sequence is similar to the reactions discussed hereinbefore and is described in detail in U.S. Pat. No. 4,721,580, supra. incorporated hereinbefore by reference.

Specific materials of the type disclosed in U.S. Pat. No. 4,721,580, supra, and useful in the present invention, include:

Soil Release Aqent II

An ester composition is made from dimethyl terephthalate, 1,2-propylene glycol and $NaO_3S(CH_2CH_2O)\bar{n}-H$ ($\bar{n}=5.9$).

This oligomer is prepared according to the procedure of Example IV of U.S. Pat. No. 4,721,580, supra. The resulting double end-capped ester composition has the empirical formula:

$$(CAP)_2(PG)_{1.75}(T)_{2.75}$$

wherein (CAP) represents $\leftarrow OCH_2CH_2)_{5.9}SO_3Na$ anionic endcapping group. This oligomer has a viscosity of about 11,000 cps at 85° C. and 3.84 $sec^{-1}$ shear rate.

Mixtures prepared in the manner described in said allowed application are generally used in the consumer products disclosed herein. However, purified samples of the individual oligomeric esters sufficient for small-scale testing and evaluation as soil release agents are generally separable from the crude compositions by means of analytical techniques such as HPLC. Likewise useable in small-scale testing are blended mixtures of esters derived from separated fractions of the analytically separable esters.

Nonionic Polvmeric Soil Release Aqent

A preferred polymeric soil release agent is a crystallizable polyester copolymer with repeat units of ethylene terephthalate units containing 10–50% by weight of ethylene terephthalate units together with 90–50% by weight of polyoxyethylene terephthalate units, derived from a polyoxyethylene glycol of average molecular weight of from about 300 to about 6,000, and the molar ratio of ethylene terephthalate units to polyoxyethylene terephthalate units in the crystallizable polymeric compound is between 2:1 and 6:1. A more preferred polymer is that wherein the polyoxyethylene terephthalate units are derived from a polyoxyethylene glycol with an average molecular weight of from about 1,000 to about 4,000. These polymers are disclosed in U.S. Pat. No. 3,416,952, McIntyre and Robertson, issued Dec. 17, 1968, incorporated herein by reference. Examples of these copolymers include the commercially available material Zelcone ® 4780 (from DuPont) and Milease ® T (from ICI), both have the Chemical Abstracts Service Registry No. 9016-88-0. Both Zelcon 4780 and Milease T are sold in the aqueous dispersion form containing up to 85% water. It is preferable to use the dehydrated polymer to prepare the fabric conditioning composition in order to avoid the incorporation of excess moisture which is believed to make the resulting fabric conditioning articles wet and sticky. The dehydrated polymer is obtained by drying the above-mentioned commercial dispersions, or can be obtained directly in the concentrated form from the manufacturers. An example of the latter is Zelcon PG, the concentrated form of Zelcon 4780, and is obtained from DuPont Co. Zelcon PG has a viscosity of higher than about 100,000 cps at 85° C. and 3.84 $sec^{-1}$ shear rate.

Other suitable polymers are disclosed in U.S. Pat. No. 4,711,730, Gosselink and Diehl, issued Dec. 8, 1987, said patent being incorporated herein by reference. Such agents include polyesters having the formula:

$$X-(OCH_2CH_2)_n-[(-OC-R^1-\overset{O}{\overset{\|}{C}}-O-R^2)_u(-OC-R^1-\overset{O}{\overset{\|}{C}}-O-R^3)_v]-OC-R^1-\overset{O}{\overset{\|}{C}}-O-(CH_2CH_2O)_n-X$$

wherein each $R^1$ is a 1,4-phenylene moiety; the $R^2$ groups are essentially 1,2-propylene moieties; and $R^3$ groups are essentially the polyoxyethylene moiety $-(CH_2CH_2O)_q-CH_2CH_2-$; each X is ethyl or, preferably, methyl; each n is from about 12 to about 45; q is from about 12 to about 100; the average value of u is from about 5 to about 30; the average value of v is from about 1 to about 10; the average value of u+v is from about 6 to about 40; and the ratio u to v is from about 1 to about 10.

Specific soil release agents of the type disclosed in U.S. Pat. No. 4,711,730, supra. and useful in the present invention, include:

Soil Release Agent III

An ester composition is made from dimethyl terephthalate, 1,2-propylene glycol, polyethylene glycol of M.W. 4000, and polyethylene glycol methyl ether of M.W. 1900. This oligomer is prepared according to the procedure of Example 2 of U.S. Pat. No. 4,711,730, supra. The resulting ester composition has the empirical formula as described above, where X is $CH_3$, n is about 43, q is about 90, v is about 2, and u is about 15. This ester composition has a viscosity of about 16,500 cps at 85° C. and 3.84 $sec^{-1}$ shear rate.

Soil Release Agent IV

An ester composition is made from dimethyl terephthalate, 1,2-propylene glycol, polyethylene glycol of M.W. 1500, and polyethylene glycol methyl ether of M.W. 750. This oligomer is prepared under reaction conditions similar to Example 1 of U.S. Pat. No. 4,711,730, supra. The resulting ester composition has the empirical formula as described above, where X is $CH_3$, n is about 16, q is about 33, v is about 10, and u is about 30. This ester composition has a viscosity of about 35,000 cps at 85° C. and 3.84 $sec^{-1}$ shear rate.

Fabric Softenino Agent

The term "fabric softening agent" as used herein includes cationic and nonionic fabric softeners used alone and also in combination with each other. A preferred fabric softening agent of the present invention is a mixture of cationic and nonionic fabric softeners.

Examples of fabric softening agents are the compositions described in U.S. Pat. No. 4,103,047, Zaki et al., issued July 25, 1978; U.S. Pat. No. 4,237,155, Kardouche, issued Dec. 2, 1980; U.S. Pat. No. 3,686,025, Morton, issued Aug. 22, 1972; U.S. Pat. No. 3,849,435, Diery et al., issued Nov. 19, 1974; and U.S. Pat. No. 4,037,996, Bedenk, issued Feb. 14, 1978; said patents are hereby incorporated herein by reference. Particularly preferred cationic fabric softeners of this type include quaternary ammonium salts such as dialkyl dimethylammonium chlorides, methylsulfates and ethylsulfates wherein the alkyl groups can be the same or different and contain from about 14 to about 22 carbon atoms. Examples of such preferred materials include ditallowalkyldimethylammonium methylsulfate (DTDMAMS), distearyldimethylammonium methylsulfate, dipalmityldimethylammonium methylsulfate and dibehenyldimethylammonium methylsulfate. Also particularly preferred are the carboxylic acid salts of tertiary alkylamines disclosed in said Kardouche patent. Examples include stearyldimethylammonium stearate, distearylmethylammonium myristate, stearyldimethylammonium palmitate, distearylmethylammonium palmitate, and distearylmethylammonium laurate. These carboxylic salts can be made in situ by mixing the corresponding amine and carboxylic acid in the molten fabric conditioning composition.

Another preferred type of fabric softener is described in detail in U.S. Pat. No. 4,661,269 of Toan Trinh, Errol H. Wahl, Donald M. Swartley and Ronald L. Hemingway, issued Apr. 28, 1987, and in the copending U.S. patent application of Allen D. Clauss, Gayle E. Culver, David M. Piatt and Thomas J. Wierenga, Ser. No. 058,449, filed June 5, 1987, said patent and said application being incorporated herein by reference.

Examples of nonionic fabric softeners are the sorbitan esters, described herein and $C_{12}$–$C_{26}$ fatty alcohols and fatty amines as described herein.

A preferred article of the present invention includes a fabric treatment composition which comprises 10% to 60% of anionic polymeric soil release agent, and 30% to 85% of a fabric softening agent, said fabric softening agent is selected from cationic and nonionic fabric softeners, and mixtures thereof. Preferably, said fabric softening agent comprises a mixture of about 5% to about 80% of a cationic fabric softener and about 10% to about 85% of a nonionic fabric softener by weight of said fabric treatment composition. The selection of the components is such that the resulting fabric treatment composition has a melting point above about 38° C. and being flowable at dryer operating temperatures.

It is desirable to intimately admix the ingredients of the fabric treatment before use and before application to a substrate dispensing means. This can be accomplished by premixing the ingredients by co-melting, co-milling, etc., or by combinations of such techniques. The viscosity lowering materials of this invention improve the process by allowing the soil release agents to be pumped into the mixing vessel and to mix more readily with the other ingredients.

A preferred fabric softening agent comprises a mixture of $C_{10}$–$C_{26}$ alkyl sorbitan esters and mixtures thereof, a quaternary ammonium salt and a tertiary alkylamine. The quaternary ammonium salt is preferably present at a level of from about 5% to about 25%, more preferably from about 7% to about 20% of the fabric conditioning composition. The sorbitan ester is preferably present at a level of from about 10% to about 50%, more preferably from about 20% to about 40%, by weight of the total fabric conditioning composition. The tertiary alkylamine is present at a level of from about 5% to about 25%, more preferably from 7% to about 20% by weight of the fabric conditioning composition. The preferred sorbitan ester comprises a member selected from the group consisting of $C_{10}$–$C_{26}$ alkyl sorbitan monoesters and $C_{10}$–$C_{26}$ alkyl sorbitan diesters, and ethoxylates of said esters wherein one or more of the unesterified hydroxyl groups in said esters contain from 1 to about 6 oxyethylene units, and mixtures thereof. The quaternary ammonium salt is preferably in the methylsulfate form. The preferred tertiary alkylamine is selected from the group consisting of alkyldimethylamine and dialkylmethylamine and mixtures thereof, wherein the alkyl groups can be the same or different and contain from about 14 to about 22 carbon atoms.

Another preferred fabric softening agent comprises a carboxylic acid salt of a tertiary alkylamine, in combination with a fatty alcohol and a quaternary ammonium salt. The carboxylic acid salt of a tertiary amine is used in the fabric conditioning composition preferably at a level of from about 5% to about 50%, and more preferably, from about 15% to about 35%, by weight of the fabric treatment composition. The quaternary ammonium salt is used preferably at a level of from about 5% to about 25%, and more preferably, from about 7% to about 20%, by weight of the total fabric treatment composition. The fatty alcohol can be used preferably at a level of from about 10% to about 25%, and more preferably from about 10% to about 20%, by weight of the fabric treatment composition. The preferred quaternary ammonium salt is selected from the group consisting of dialkyl dimethylammonium salt wherein the alkyl groups can be the same or different and contain from about 14 to about 22 carbon atoms and wherein the counteranion is selected from the group consisting of chloride, methylsulfate and ethylsulfate, preferably methylsulfate. The preferred carboxylic acid salt of a tertiary alkylamine is selected from the group consisting of fatty acid salts of alkyldimethylamines wherein the alkyl group contains from about 14 to about 22 carbon atoms, and the fatty acid contains from about 14 to about 22 carbon atoms, and mixtures thereof. The preferred fatty alcohol contains from about 14 to about 22 carbon atoms.

Optional Ingredients

Well known optional components included in the fabric conditioning composition which are useful in the present invention are narrated in U.S. Pat. No. 4,103,047, Zaki et al., issued July 25, 1978, for "Fabric Treatment Compositions," incorporated herein by reference.

Very useful optional ingredients are other viscosity control agents, especially particulate clays. Examples of the particulate clays useful in the present invention are described in U.S. Pat. No. 4,103,047, supra. which is incorporated herein by reference. A preferred clay viscosity control agent is calcium bentonite clay, available from Southern Clay Products under the trade name Bentolite ® L. The clay viscosity control agent is preferably present at a level of from about 0.5% to about 15%, more preferably from about 3% to about 8% by weight of the fabric conditioning composition.

Another preferred optional ingredient is perfume, which is very useful for imparting odor benefits. Perfume is preferably present at a level of from about 0.25% to about 10% by weight of the portion of the composition that is transferred to the fabrics, e.g., everything but the dispensing means.

Dispensing Means

The fabric treatment compositions can be employed by simply adding a measured amount into the dryer, e.g., as liquid dispersion. However, in a preferred embodiment, the fabric treatment compositions are provided as an article of manufacture in combination with a dispensing means such as a flexible substrate which effectively releases the composition in an automatic clothes dryer. Such dispensing means can be designed for single usage or for multiple uses.

The dispensing means will normally carry an effective amount of fabric treatment composition. Such effective amount typically provides sufficient fabric conditioning agent and/or anionic polymeric soil release agent for at least one treatment of a minimum load in an automatic laundry dryer. Amounts of fabric treatment composition for multiple uses, e.g., up to about 30, can be used. Typical amounts for a single article can vary from about 0.25 g to about 100 g, preferably from about 0.5 g to about 10 g, most preferably from about 1 g to about 5 g.

One such article comprises a sponge material releasably enclosing enough fabric treatment composition to effectively impart fabric soil release and softness benefits during several cycles of clothes. This multi-use article can be made by filling a hollow sponge with about 20 grams of the fabric treatment composition.

Other devices and articles suitable for dispensing the fabric treatment composition into automatic dryers include those described in U.S. Pat. No. 4,103,047, Zaki et al., issued July 25, 1978; U.S. Pat. No. 3,736,668, Dillarstone, issued June 5, 1973; U.S. Pat. No. 3,701,202, Compa et al., issued Oct. 31, 1972; U.S. Pat. No. 3,634,947, Furgal, issued Jan. 18, 1972; U.S. Pat. No. 3,633,538, Hoeflin, issued Jan. 11, 1972; and U.S. Pat. No. 3,435,537, Rumsey, issued Apr. 1, 1969. All of these patents are incorporated herein by reference.

A highly preferred article herein comprises the fabric treatment composition releasably affixed to a flexible substrate in a sheet configuration. Highly preferred paper, woven or nonwoven "absorbent" substrates useful herein are fully disclosed in Morton, U.S. Pat. No. 3,686,025, issued Aug. 22, 1972, incorporated herein by reference. It is known that most substances are able to absorb a liquid substance to some degree; however, the term "absorbent" as used herein, is intended to mean a substance with an absorbent capacity (i.e., a parameter representing a substrate's ability to take up and retain a liquid) from 4 to 12, preferably 5 to 7, times its weight of water.

Determination of absorbent capacity values is made by using the capacity testing procedures described in U.S. Federal Specifications UU-T-595b, modified as follows:

1. tap water is used instead of distilled water;
2. the specimen is immersed for 30 seconds instead of 3 minutes;
3. draining time is 15 seconds instead of 1 minute; and
4. the specimen is immediat on a torsion balance having a pan with turned-up edges.

Absorbent capacity values are then calculated in accordance with the formula given in said Specification. Based on this test, one-ply, dense bleached paper (e.g., kraft or bond having a basis weight of about 32 pounds per 3,000 square feet) has an absorbent capacity of 3.5 to 4, commercially available household one-ply toweling paper has a value of 5 to 6; and commercially available two-ply household toweling paper has a value of 7 to about 9.5.

Using a substrate with an absorbent capacity of less than 4 tends to cause too rapid release of the fabric treatment composition from the substrate resulting in several disadvantages, one of which is uneven conditioning of the fabrics. Using a substrate with an absorbent capacity over 12 is undesirable, inasmuch as too little of the fabric treatment composition is released to condition the fabrics in optimal fashion during a normal drying cycle.

Such a substrate comprises a nonwoven cloth having an absorbent capacity of preferably from about 5 to 7 and wherein the weight ratio of fabric treatment composition to substrate on a dry weight basis ranges from about 5:1 to 1:1.

Nonwoven cloth substrate preferably comprises cellulosic fibers having a length of from 3/16 inch to 2 inches and a denier of from 1.5 to 5 and the substrate is adhesively bonded together with a binder resin.

The flexible substrate preferably has openings sufficient in size and number to reduce restriction by said article of the flow of air through an automatic laundry dryer. The better openings comprise a plurality of rectilinear slits extended along one dimension of the substrate.

Usage

The method aspect of this invention for imparting the abovedescribed fabric treatment composition to provide soil release, softening and antistatic effects to fabrics in an automatic laundry dryer comprises: commingling pieces of damp fabrics by tumbling said fabrics under heat in an automatic clothes dryer with an effective amount of the fabric treatment composition, said composition having a melting point greater than about 35° C. and being mobilized, e.g., flowable at dryer operating temperature, said composition comprising from about 1% to 70% of a polymeric soil release agent, from about 1% to about 35% of viscosity lowering material and from about 30% to about 95% of a fabric conditioning agent selected from the above-defined cationic and nonionic fabric softeners and mixtures thereof.

The method herein is carried out in the following manner. Damp fabrics, usually containing from about 1 to about 3.5 times their weight of water, are placed in the drum of an automatic clothes dryer. In practice, such damp fabrics are commonly obtained by laundering, rinsing and spin-drying the fabrics in a standard washing machine. The fabric treatment composition can simply be spread uniformly over all fabric surfaces, for example, by sprinkling the composition onto the fabrics from a shaker device. Alternatively, the composition can be sprayed or otherwise coated on the dryer drum, itself. The dryer is then operated in standard fashion to dry the fabrics, usually at a temperature from about 50° C. to about 80° C. for a period from about 10 minutes to about 60 minutes, depending on the fabric load and type. On removal from the dryer, the dried fabrics have been treated for soil release benefits and are softened. Moreover, the fabrics instantaneously sorb a minute quantity of water which increases the electrical conductivity of the fabric surfaces, thereby quickly and effectively dissipating static charge.

In a preferred mode, the present process is carried out by fashioning an article comprising the substrate-like dispensing means of the type hereinabove described in releasable combination with a fabric treatment composition. This article is simply added to a clothes dryer together with the damp fabrics to be treated.

After one treatment in an automatic clothes dryer with an article of the present invention, the fabrics, and especially polyester fabrics, will have acquired a noticeable soil release benefit. When the said fabrics are washed in an automatic clothes washer the soil release agent is redistributed more evenly on the surface of said fabrics to provide a more uniform soil release benefit. Additional treatment cycles provide improved soil release benefits.

All percentages, ratios, and parts herein are by weight unless otherwise stated.

The following are nonlimiting examples of the instant articles and methods.

Examples of Viscosity Reduction

EXAMPLE 1

Soil release agent I has a viscosity of about 40,000 cps as determined at 85° C. and 3.84 $sec^{-1}$ shear rate. The viscosity of this material is reduced by mixing, with agitation, about 25 parts of $C_{16}$—$C_{18}$ fatty acid to 75 parts of Soil Release Agent I maintained at about 120° C. in its reaction vessel. The resulting mixture is phase stable in the liquid state, and has a viscosity of about 7,000 cps at 85° C. and 3.84 $sec^{-1}$ shear rate.

EXAMPLE 2

Zelcon PG, as received, has a viscosity of about 200,000 cps at 85° C.. The viscosity of this polymer is reduced by melting 75 parts of the polymer and keeping it molten at 120° C., then mixing, with agitation, 25 parts of molten $C_{16}$-$C_{18}$ fatty acid. The resulting mixture is phase stable in the molten state and has a viscosity of about 7,400 cps at 85° C. and 3.84 $sec^{-1}$ shear rate.

Other Examples are given in Table 1.

TABLE I

| Example No. | Soil Release Agents (SRA) | Organic Viscosity Modifiers (OVM) | SRA/OVM Ratio | Viscosity (cps at 85° C./3.84 sec.−1 |
|---|---|---|---|---|
| 3 | SRA I | Ethylene glycol | 85/15 | 4100 |
| 4 | SRA I | Ethylene glycol | 75/25 | 2800 |
| 5 | SRA I | Propylene glycol | 85/15 | 4900 |
| 6 | SRA I | Propylene glycol | 75/25 | 2800 |
| 7 | SRA I | 1,3-Propane diol | 85/15 | 5800 |
| 8 | SRA I | 1,3-Propane diol | 75/25 | 2700 |
| 9 | SRA I | PEG (300) | 75/25 | 4500 |
| 10 | SRA I | PEG (1000) | 75/25 | 9600 |
| 11 | SRA I | $CH_3(CH_2)_{10}COOH$ | 75/25 | 6000 |
| 12 | SRA I | $C_8H_{17}$—$C_6H_4$—$(OCH_2CH_2)_{1.5}OH$ | 75/25 | 5800 |
| 13 | SRA I | $C_9H_{19}$—$C_6H_4$—$(OCH_2CH_2)_{1.5}OH$ | 75/25 | 6400 |
| 14 | SRA I | $C_9H_{19}$—$C_6H_4$—$(OCH_2CH_2)_4$—OH | 75/25 | 7200 |
| 15 | SRA I | $C_{16}$-$C_{18}$ fatty acid and $C_9H_{19}$—$C_6H_4$—$(OCH_2CH_2)_{1.5}$—OH | 75/(12.5/12.5) | 7700 |
| 16 | SRA I | $C_9H_{19}$—$C_6H_4$—$(OCH_2CH_2)_{1.5}$—OH and n-$C_{18}H_{37}$—OH | 75/(10/15) | 6800 |
| 17 | SRA I | $C_{16}$-$C_{18}$ fatty acid and ethylene glycol | 75/(10/5) | 9800 |
| 18 | SRA II | $C_{16}$-$C_{18}$ fatty acid | 75/25 | 4300 |
| 19 | SRA IV | $C_{16}$-$C_{18}$ fatty acid | 75/25 | 6300 |

Example of Fabric Conditioning Articles

EXAMPLE 20

A dryer-added fabric conditioning article comprising a rayon nonwoven fabric substrate (having a weight of 1.22 gm per 99 sq. in.) and a fabric conditioning composition is prepared in the following manner.

Preparation of the Fabric Treatment Mixture

A blend of 21.60 parts of ditallowdimethylammonium methyl sulfate (DTDMAMS) (sold by Sherex Chemical Co.) and 32.40 parts of sorbitan monostearate (sold by Mazer Chemicals, Inc.) is melted and mixed well at 80° C. To this mixture, 40 parts of the soil release agent mixture of Example 1, containing 30 parts of the Soil Release Agent I and 10 parts of fatty acid, at 85° C. is added with high-shear mixing to finely disperse the soil release agent mixture. The temperature of the mixture is kept between 70°-80° C. using a water bath. After the addition is completed, 6 parts of Bentolite L particulate clay (sold by Southern Clay Products) is added slowly while maintaining the high-shear mixing action to make the fabric treatment mixture.

Preparation of Fabric Conditioining Sheets

The fabric treatment mixture is applied to preweighed nonwoven substrate sheets of a 9 inch×11 inch (approximately 23×28 cm) dimension. The substrate sheets are comprised of 70% 3-denier, 1-9/16 inch (approximately 4 cm) long rayon fibers with 30% polyvinyl acetate binder. A small amount of the fabric treatment mixture is spread on a heated metal plate with a spatula and a nonwoven sheet is placed on it to absorb the fabric treatment mixture. More mixture is added to the sheet by using a spatula to evenly distribute it onto the sheet. The sheet is then removed from the heated metal plate and allowed to cool to room temperature so that the fabric treatment mixture can solidify. The sheet is weighed to determine the amount of fabric treatment mixture on the sheet. The target amount is 3.0 g per sheet. Each sheet contains about 0.9 g of Soil Release Agent I. If the weight is under the target weight, the sheet is placed on the heated metal plate and more fabric treatment mixture is added. If the weight is in excess of the target weight, the sheet is placed back on the heated metal plate to remelt the fabric treatment mixture and remove some of the excess.

EXAMPLE 21

A blend of 18.36 parts of octadecyldimethylamine (Ethyl Corp.) and 15.64 parts of $C_{16}$-$C_{18}$ fatty acid (Emery Industries, Inc.) is melted at 80° C., and a blend of 14.71 parts of DTDMAMS (Sherex Chemical Co.) and 14.71 parts of sorbitan monostearate (Mazer Chemicals, Inc.) is melted at 80° C. The two blends are then mixed together to form the softener component.

Next, the soil release agent mixture of Example 3, containing 25 parts of the Soil Release Agent I and 4.41 parts of ethylene glycol (Fisher Scientific) is added with high-shear mixing while the temperature of the softener is kept between 70°-80° C. using a water bath, until all of the soil release agent mixture has been mixed into the softener matrix.

Finally, the calcium bentonite clay (6 parts, Bentolite L from Southern Clay Co.) is added with high-shear mixing to make the fabric treatment mixture.

The preparation of the fabric conditioning sheets is similar to that in Example 20. The target coating weight is 3.0 g per sheet. Each sheet containing about 0.75 g of Soil Release Agent I.

EXAMPLES 22 and 23

The preparations of the fabric treatment mixtures and fabric conditioning sheets of Examples 22 and 23 are similar to that in Example 21. The compositions of ingredients are given in Table 2. The target coating weight is 2.92 g per sheet. Each sheet contains about 0.75 g of soil release agent.

TABLE 2

| Examples | 22 (wt. %) | 23 (wt. %) |
|---|---|---|
| Ingredients | | |
| Octadecyldimethylamine | 17.09 | 17.09 |
| $C_{16}$-$C_{18}$ Fatty Acid | 15.64 | 15.64 |
| Sorbitan Monostearate | 13.69 | 13.69 |
| DTDMAMS | 13.69 | 13.69 |
| Calcium Bentonite Clay[a] | 5.64 | 5.64 |
| Soil Release Agent Mixture | | |
| Soil Release Agent I | 25.68 | — |
| Soil Release Agent IV | — | 25.68 |
| Octylphenol ethoxylate[b] | 8.57 | — |
| $C_{16}$-$C_{18}$ Fatty Acid | — | 8.57 |
| Total | 100.00 | 100.00 |

[a]Bentolite L sold by Southern Clay Products.
[b]Igepal CA-210 sold by GAF Chemicals Corp.

EXAMPLE 24

A dryer-added fabric conditioning article comprising a rayon nonwoven fabric substrate (having a weight of 1.22 gm per 99 sq. in. (approximately 639 $cm^2$) and a fabric treatment composition is prepared in the following manner.

A fabric softening agent premixture is initially prepared by admixing 1620 parts octadecyldimethylamine with 1483 parts $C_{16}$–$C_{18}$ fatty acid at 70° C. The softening agent mixture is completed by then adding and mixing in 1298 parts sorbitan monostearate and 1298 parts ditallowdimethylammonium methylsulfate at 70° C. To the softening agent mixture, 3425 parts of premelted and premixed Soil Release Agent I (2568 parts) and $C_{16}$–$C_{18}$ fatty acid (857) parts at 85° C. are added slowly and with high shear mixing to finely disperse the polymer-fatty acid blend. After the addition is completed and a sufficient period of mixing time has elapsed, 534 parts of Bentolite L particulate clay is added slowly while maintaining the high-shear mixing action. An amount of 342 parts of perfume is added to complete the preparation of the fabric conditioning composition.

The flexible substrate, comprised of 70% 3-denier, 1-9/16" (approximately 4 cm) long rayon fibers and 30% polyvinyl acetate binder, is impregnated by coating one side of a continuous length of the substrate and contacting it with a rotating cylindrical member which serves to press the liquified mixture into the interstices of the substrate. The amount of fabric treatment mixture applied is controlled by the flow rate of the mixture and/or the line speed of the substrate. In this Example 24, the application rate provides about 2.92 g of fabric treatment mixture (about 0.75 g of Soil Release Agent I) per individual sheet. The substrate is passed over several chilled tension rolls which help solidify the conditioning mixture. The substrate sheet is 9 inches (approximately 28 cm) wide and is perforated in lines at 11 inches (approximately 28 cm) intervals to provide detachable sheets. Each sheet is cut with a set of knives to provide three evenly spaced parallel slits averaging 4 inches (approximately 10 cm) in length.

What is claimed is:

1. A composition of matter comprising a mixture of:

(A) a soil release polymer having a viscosity at about 85? C. of greater than about 10,000 cps; and (B) an effective amount, but an amount that gives a ratio of (A) to (B) of more than about 1:1, of a viscosity reducing agent selected from the group consisting of:

(a) polyhdroxy compounds containing from 2 to about 4 hydroxyl groups and from 2 to about 6 carbon atoms;

(b) alkyl ethers of propylene glycol containing from one to two alkyl groups wherein each alkyl groups contains from about 4 to about 6 carbon atoms;

(c) dialkyl ethers of ethylene glycol wherein each alkyl group contains from about 4 to about 6 carbons atoms; and (d) mixtures thereof;

said muxture of (A) and (B) forming a phase stable mixture at about 85° C. with a viscosity of less than about 10,000 cps.

2. The composition of matter of claim 1 wherein said viscosity reducing agent (B) is a polyhydroxy solvent containing from 2 to about 4 hydroxy groups and from 2 to about 6 carbon atoms.

3. The composition of matter of claim 1 wherein said soil release polymer (A) comprises is an anionic soil release polymer.

4. The composition of matter of claim 1 wherein said soil release polymer (A) comprises is a nonionic soil release polymer.

5. An article of manufacture adapted for use to provide fabric soil release benefits and to soften fabrics in an automatic laundry dryer comprising:

I. a fabric conditioning composition having a melting point above about 35° C. and being flowable at dryer operation temperatures, said composition comprising:

i. about 1% to about 70% of a mixture comprising:

(A) from about 1% to about 70% based on the weight of said composition of a polymeric soil release agent having a viscosity at 85° C. of more than about 10,000 cps; and (B) from about 1% to about 35% of a viscosity reducing agent selected from the group consisting of:

(a) polyhydroxy compounds containg from 2 to about 4 hydroxyl groups and from 2 to about 6 carbon atoms;

(b) alkyl ethers of propylene glycol containing from one to two alkyl groups wherein each alkyl group contains from about 4 to about 6 carbon atoms;

(c) dialkyl ethers of ethylene glycol wherein each alkyl group contains from about 4 to about 6 carbon atoms; and (d) mixtures thereof;

to lower said viscosity of said polymeric soil release agent (A) to less than about 10,000 cps at about 85° C.; and ii. from about 30% to about 99% of a fabric softening agent; and II. A dispensing means which provides for release of an effective amount of said composition to fabrics in the dryer at automatic dryer operating temperatures.

6. The article of manufacture of claim 5 wherein said soil release polymer comprises an anionic soil release polymer.

7. The article of manufacture of claim 6 wherein said viscosity reducing agent (B) comprises polyhydroxy solvent containing from 2 to about 4 hydroxy groups and from 2 to about 6 carbon atoms.

8. The process of preparing the article of manufacture of claim 6 comprising the step wherein (A) and (B) are first admixed to form a premix which is then admixed with said fabric softener ii.

* * * * *